United States Patent [19]

Allen et al.

[11] 4,036,725

[45] July 19, 1977

[54] WHEEL SELECTIVE JET PLATING SYSTEM

[75] Inventors: Robert M. Allen, Mill Valley; Michael Seyffert, Santa Cruz, both of Calif.

[73] Assignee: National Semiconductor Corporation, Santa Clara, Calif.

[21] Appl. No.: 634,046

[22] Filed: Nov. 21, 1975

[51] Int. Cl.[2] ..... C25D 17/00

[52] U.S. Cl. ..... 204/206; 204/199; 204/224 R

[58] Field of Search ..... 204/206, 199–211, 204/224 R, 198

[56] References Cited

U.S. PATENT DOCUMENTS

| | | | |
|---|---|---|---|
| 3,640,854 | 8/1972 | Klein | 204/28 |
| 3,819,502 | 6/1974 | Meuldijk et al. | 204/206 |
| 3,855,108 | 12/1974 | Bolz et al. | 204/206 |

*Primary Examiner*—F.C. Edmundson

*Attorney, Agent, or Firm*—Gail W. Woodward; Willis E. Higgins

[57] ABSTRACT

A selective jet plating system having a plurality of stationary, plating jets and a pair of split concentric annular rotatable members for continuously plating metal on a metal strip is described. The rotatable members are provided for transporting the metal strip continuously past the jets. The fluid jets are spaced in a circle interior of the annular members for jetting plating fluid radially outwardly through an adjustable slot between the annular members against the strip as the strip is transported by the annular members past the jets. Also provided is a plurality of cathode electrodes which are provided at spaced locations along the path of travel and in sliding contact with the strip. The jets are made of a fluid-compatible metallic material for forming an anode. A back-up belt is also provided for providing a back-up for the strip to prevent fluid loss through the strip if the strip has holes in it. The annular members are further provided to be adjustable relative to each other and to the strip for adjusting the width and position of the plating deposited on the strip.

15 Claims, 5 Drawing Figures

WHEEL SELECTIVE JET PLATING SYSTEM

BACKGROUND OF THE INVENTION

The present invention relates to metallic strip plating apparatus in general and in particular to apparatus for continuously plating metal on a metal strip having a plurality of stationary fluid jets and a pair of split concentric annular rotatable members for continuously transporting a metal strip past the jets.

Plating apparatus of the type relating to the present invention is used for plating lead frames used by the semiconductor industry in the fabrication of integrated circuits and the like. Typically, a strip to be plated comes in a large coil. The strip is unwound from the coil and fed through a plating apparatus and plated with one or several different types of metals. When a plurality of metals are plated on a single strip, a separate plating apparatus is provided for each metal. Typically, the apparatus thus provided is placed side by side and in series relative to the strip.

Initially, when any part of a strip is required to be plated, the entire surface of the strip, or at least the entire surface on one side of a strip was plated. When one or both sides of a strip are plated in their entirety, a great deal of material is required. Since only a portion of a strip is frequently all that is required to be plated, there is waste and needless cost both in terms of money and in materials.

Another form of strip plating apparatus which is also in use is called a step selective plating apparatus. In apparatus of this type, there is provided a plurality of stationary fluid jets positioned along a line between a pair of rails or side walls. A strip to be plated is introduced into one end of the apparatus, passes over the jets and exits from the opposite end. The strip is introduced in a step fashion. The strip is moved a predetermined distance over the jets while the jets are turned off. The jets are then turned on and the strip is plated. After a predetermined time the jets are once again turned off and the apparatus replenished with a fresh unplated length of strip.

It will be appreciated that the "step" type apparatus tends to be slow, and possibly even more importantly, if any of the jets is clogged, a non-uniform plating will result.

Still another type of selective strip plating apparatus is provided with a rotatable wheel-like assembly. In the interior of the wheel assembly is a fluid manifold. Coupled to the fluid manifold is a plurality of fluid jets or simply a fluid outlet, for dispensing plating fluid through a slot in the periphery of the wheel assembly and against a strip transported thereon. As the wheel-like assembly is rotated carrying the strip on its periphery, the fluid jets or other fluid outlets also rotate therewith since they typically constitute an integral part thereof.

Unlike the "step" type apparatus described above, the rotatable wheel and fluid jet assembly is considered a high-speed plating apparatus; however, like the "step" type apparatus, if any of the jets or other fluid outlets becomes clogged, a non-uniform plating will result. This is due to the fact that in both types of plating apparatus, a single jet or outlet, and none other, is associated with a single section of strip.

SUMMARY OF THE INVENTION

In view of the foregoing, a principal object of the present invention is a selective strip plating apparatus which has the advantages of high speed and provides a uniform plating even if one or more fluid jets or other plating outlets is clogged.

Another object of the present invention is a strip plating apparatus for selectively adjusting the area and position of a plate on a strip.

Still another object of the present invention is a strip plating apparatus of the type described hereinabove having a back-up belt for backing up a strip to be plated in which there are holes for preventing the loss of plating fluid through the holes.

Amont the features of an apparatus made according to the present invention, there is a stationary plating fluid manifold. The manifold is located at or in the center or hub of a rotatable wheel assembly. Coupled to the manifold for jetting plating fluid radially outwardly from the center of the wheel assembly is a plurality of fluid jets. Each of the jets is made of a plating fluid-compatible metallic material such as platinum, for forming an anode.

Adapted to be rotated relative to the hub of the wheel assembly is a pair of split concentric annular rotatable members. The members are located above and below the fluid jets. In the interior of the rotatable members there is formed a fluid chamber into which the jets project. At the outer periphery of the members, where the members are split, there is provided a slot. Against the outer surface of the rotatable members and on opposite sides of the slot is a pair of sealing surfaces against which the strip is sealed. The edges of the slot determine the boundaries of the plating on the strip.

At four locations about the periphery of the rotatable wheel members, there are provided four wheel means or rollers. One of the rollers is a drive roller. Each of the rollers is provided with an upper and lower rim member for capturing a rim of the upper and lower annular rotatable members for supporting the members. In each of the rollers there is also provided means for adjusting the relative position of the top and bottom of the rollers to adjust the relative position of the upper and lower rotatable wheel members and hence the size and position of the slot between them relative to a strip carried on their periphery.

Means forming a slidable cathode for making contact with a strip on the rotatable members of the wheel assembly is also provided.

DESCRIPTION OF THE DRAWINGS

The above and other objects, features, and advantages of the present invention will become apparent from a detailed description below and the accompanying drawings in which.

DETAILED DESCRIPTION

Figure 1:
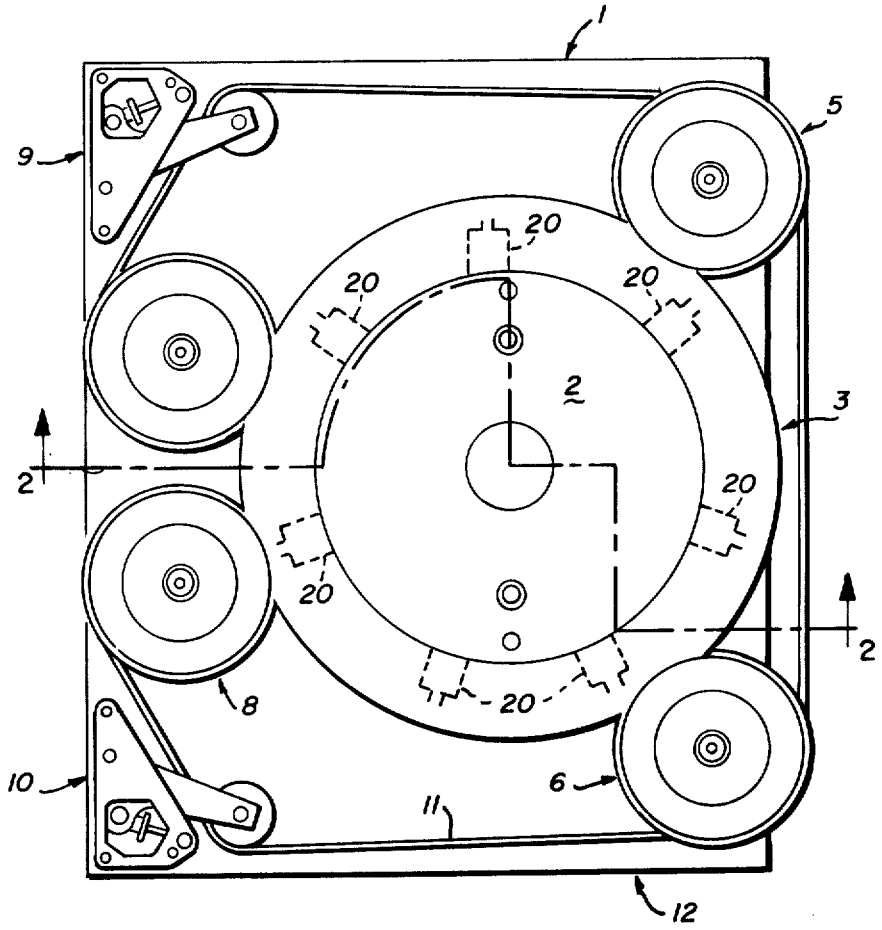
FIG. 1 is a plan view of a selective strip plating apparatus according to the present invention.
Figure 2:
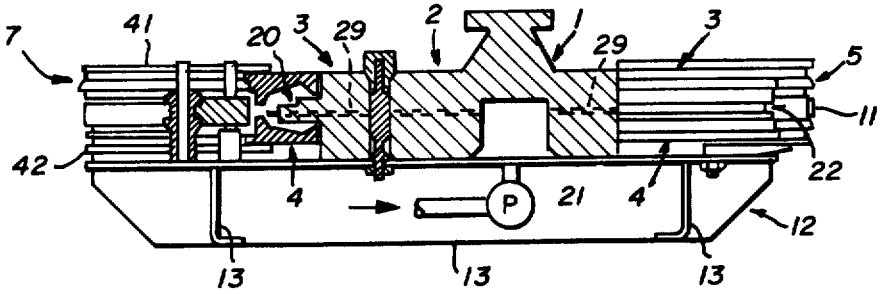
FIG. 2 is a cross-sectional view taken along lines 2—2 of FIG. 1.

Referring to FIGS. 1 and 2, there is provided, in accordance with the present invention, a selective strip plating apparatus 1. In apparatus 1, there is provided a stationary center or hub member 2. Rotatable about the periphery of hub member 2 is a pair of rotatable rim members 3 and 4. At four locations, generally at the rear corners and near the front center of the apparatus 1, are four rollers assemblies 5, 6, 7 and 8, respectively. On opposite sides of front roller assemblies 7 and 8, there is provided a pair of idler roller assemblies 9 and 10. Threaded about the roller assemblies 5-10 and rim members 3 and 4 is a belt 11. All of the above described members and assemblies are mounted on a supporting member 12 having downwardly depending wall members 13 for supporting the apparatus 1 in the base of a fluid container (not shown).

Figure 3:
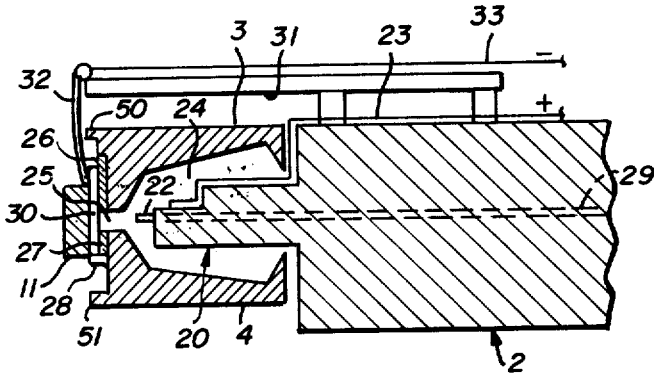
FIG. 3 is an enlarged cross-sectional view of a fluid jet and the rotatable rim members.

Referring to FIGS. 2 and 3, there is provided about the periphery of hub member 2, a plurality of fluid jet members 20. In FIG. 1, jet members 20 are shown in broken lines. In the center of hub member 2 is a fluid manifold 21 which is coupled by a plurality of fluid passageways 29 to each of the fluid jet members 20. Each of the fluid jet members 20 is terminated by an adjustable nozzle 22. Nozzle 22 is made of a plating fluid-compatible metallic material, such as platinum. This is to prevent corrosion and contamination of the plating fluid which would occur if the nozzle were made of a material which is soluble in the plating fluid. Coupled to each of the nozzles 22, as by a wire 23, is the positive pole of a d.c. potential source represented by conventional plus and minus signs in FIG. 3.

As shown most clearly in FIG. 3, the interior of of rotatable rim members 3 and 4 is cut away so as to provide a cavity 24 into which the fluid jet members 20 project. Cavity 24 is provided for receiving and containing spent plating fluid. From cavity 24, the spent fluid is permitted to drain back to a fluid sump such as the container in which the apparatus is supported on walls 13. From the container, the fluid is recycled through the manifold 21 and jets 20 by a conventional fluid mump P.

Between the rim members 3 and 4, there is a slot 25. On the surface of the rim members 3 and 4 and adjacent to the slot 25, is a pair of sealing members 26 and 27. Members 26 and 27 form a fluid-tight seal with a strip 30 wrapped about the rim members 3 and 4, as will be described. As a back-up for the strip 30 and principally for preventing a loss of fluid through the strip 30 and the plating of parts of the strip 30 which are not immediately facing the slot 25 when the strip 30 has holes in it, there is provided the flexible back-up belt 11.

Supported on the top of hub member 23 and extending over the rim member 3 is a cantilevered bracket member 31. Member 31 is provided for supporting at its outer extremity, a plurality of stationary cathode electrode members 23. Each of the members 32 is pivotably supported from the member 31 for making a sliding electrical contact with the surface of the strip 30. Coupled to members 32, as by a wire 33, is the negative pole of the d.c. source coupled to the nozzle 22. Thus, the nozzles 22 are made anodes and the members 32 are made cathodes in the apparatus.

The rim members 3 and 4 are rim supported by the rim rollers 5–8 and driven by the roller 5. Since the rim supporting rollers 5–8 are substantially identical except that roller 5 is coupled to a motor or the like for driving the rim members 3 and 4, only roller 8 need be described.

Figure 4:
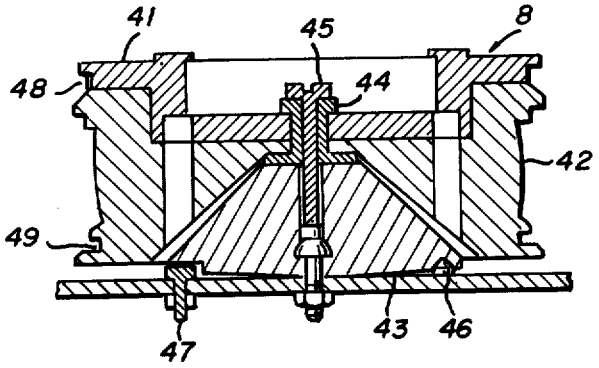
FIG. 4 is a cross-sectional view of one of the roller assemblies according to the present invention.

Referring to FIGS. 2 and 4, there is provided in each of the rollers 5–8, an upper rotatable member 41 and a lower rotatable member 42. Members 41 and 42 are rotatably supported on a conically-shaped supporting member 43 by means of a bushing 44 and a pin, bolt or the like 45. Near the periphery of the base of the member 43, and in contact therewith, is a resilient spring-like member 46. Diametrically opposite from member 46 is an adjusting screw 47. An adjustment of the adjusting screw 47 can be made for adjusting the position of the member 43 and the axis of rotation of the members 41 and 42 with respect to the rim members 3 and 4.

Referring to their periphery, there is provided in each of the members 41 and 42, respectively, an inwardly extending shouldered slot-like recess 48 and 49. Corresponding to the recesses 48 and 49, there is provided at the periphery of the upper and lower rotatable members 3 and 4, respectively, as seen in FIG. 3, a radially extending flange member 50 and 51. Flange members 50 and 51, extending entirely around the members 3 and 4, are adapted to fit within the recesses 48 and 49. Thus, the flange 50 of rim member 3 fits into the recess 48 and the flange 51 of rim member 4 fits into the recess 49 of the upper and lower members 41 and 42, respectively, of each of the rollers 5, 6, 7 and 8. When positioned between the rollers 5, 6, 7 and 8, the rim members 3 and 4 are supported entirely by the rollers. Roller 5, in addition, is coupled to a motor or the like (not shown) for driving the rim members 3 and 4 about the hub member 2.

Figure 5:
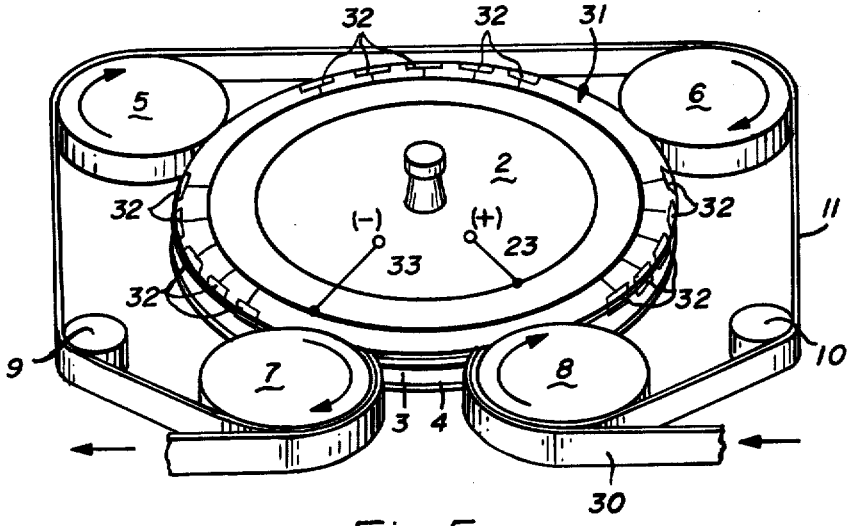
FIG. 5 is a front top-quarter perspective diagrammatic representation of the apparatus of FIG. 1.

Referring to FIG. 5, in operation the strip 30 is caused to pass between the roller 8 and belt 11 and the rim members 3 and 4. The belt 11 presses tightly against the back of the strip 30 for preventing a loss of fluid through any holes that may be in the strip. The width of the belt 11 is such that an upper surface portion of the strip 30 is exposed for sliding contact with the cathode electrodes. From roller 8, the strip 30 passes about the rim members and exits the apparatus at roller 7.

The plating solution or bath is electrically equivalent to a resistor. Accordingly, by adjusting the position of the anodes — i.e., nozzles 27 — relative to the strip 30, current flow about the periphery of the rim members and in the strip 30 at different positions of the rim members can be adjusted for providing different plating characteristics — e.g., grain structure, etc. Similarly, the use of a plurality of cathodes as distinguished from one or two or just a few cathode members provides for improved current distribution in the strip 30 and consequently better plating characteristics.

In those applications wherein the strip to be plated is solid, the belt 11 need not be used. The strip 30 itself will be pulled and maintained taut against the sealing members 26 and 27 by the rollers 5–8 for plating a stripe on the strip having the width of the slot 25. To adjust the width of the plated area on the strip 30, the relative position of the upper and lower rim members 3 and 4 is adjusted for adjusting the width of the slot 25. This is accomplished by adjusting the relative position of the upper and lower members 41 and 42 of rollers 5–8 which support the flange members 50 and 51 at the rims of members 3 and 4.

Referring to FIG. 3, there is also provided a lower strip supporting member 28. Member 28 is attached to the rim member 4 below the slot 25 for supporting the lower edge of the strip 30. To change the position of the strip 30 relative to the slot 25 and, hence, to change the position of a strip plated on the strip, the supporting member 28 is raised or lowered the necessary distance.

A single embodiment of the invention has been described. It is clear from the foregoing that numerous modifications and changes made be made to the embodiment described within the spirit and scope of the present invention. For example, while the various non-electrically conductive parts are typically fabricated from a plastic or plastic-like material which is compatible with the plating fluid and is not soluble therein, there are a variety of such types of materials which may be used. The electrically conductive parts are generally made of platinum or other fluid-compatible material. The various mechanical arrangements are obviously subject to changes in their details. Accordingly, it is intended that the above be taken only as illustrative of a preferred embodiment and that reference be made for the true scope of the invention to the claims hereinafter provided.

What is claimed is:

1. An apparatus for electroplating metal on a continuous metal strip comprising:

a plurality of stationary fluid jets spaced along a circular line for jetting a plating fluid containing a metal against said strip;

a central assembly for supporting said fluid jets in a fixed position relative to said strip, said central assembly including means for coupling said jets to a source of plating fluid under pressure;

means for moving said strip in a circular path past said jets while said fluid is being jetted from said jets against said strip;

said moving means comprising:

an annular ring-shaped assembly mounted for rotation about said central assembly, said ring-shaped assembly having an upper and a lower outer peripheral edge;

a slot between said edges in registration with said fluid jets; and means located on opposite sides of said slot forming a fluid-sealing means between said strip and said ring-shaped assembly for masking a predetermined surface area of said strip;

means for rotating said ring-shaped assembly about said central assembly;

means for holding said strip against said masking means in a fluid-tight sealing relationship therewith as said ring-shaped assembly is rotated about said central assembly; and, means for causing a current to flow in said fluid; including means for coupling a d.c. current source between said strip and said fluid jets whereby said metal in said plating fluid is removed from said fluid and plated on the surface of said strip between said masking means as said strip is moved past said fluid jets.

2. An apparatus according to claim 1 wherein said ring-shaped assembly mounted for rotation about said central assembly comprises a rim member extending from each of said upper and lower edges and further comprising:

a plurality of rotatable supporting wheel members, each of said wheel members having an upper and lower rim-receiving shoulder for receiving, respectively, said rim members extending from said upper and lower edges of said ring-shaped assembly whereby said wheel members rotatably support said ring-shaped assembly relative to said central assembly.

3. An apparatus according to claim 2 wherein said ring-shaped assembly comprises an upper ring-shaped member and a lower ring-shaped member; and means for adjusting to relative position of said upper and lower ring-shaped members whereby said slot is adjustable for adjusting the width of the surface area plated on said strip.

4. An apparatus according to claim 3 wherein said adjusting means comprises means for adjusting the relative position of said upper and lower rim-receiving shoulders of said plurality of rotatable supporting wheel members.

5. An apparatus according to claim 4 further comprising means forming a strip back-up means for covering a predetermined portion of the outer surface of said strip in a fluidtight manner as said strip is transported about said ring-shaped assembly for preventing a loss of plating fluid through holes in said strip located between said masking means.

6. An apparatus according to claim 5 wherein said strip back-up means comprises an endless resilient belt member and further comprising means for routing said belt member about said ring-shaped assembly and said supporting wheel members in such a manner that said strip can be fed into and from said apparatus in a continuous manner.

7. An apparatus according to claim 6 further comprising means for applying tension on said belt member and means for adjusting said tension.

8. An apparatus according to claim 7 wherein said means for coupling said current source to said strip comprises means for making a sliding electrical contact with said strip as said strip is moved relative thereto.

9. An apparatus according to claim 8 wherein said means for making a sliding electrical contact with said strip comprises a plurality of spaced apart sliding electrical contact members for making a sliding electrical contact with said strip at a corresponding plurality of locations on said strip for obtaining a predetermined distribution of current density in said strip relative to the position of said strip on said ring-shaped assembly.

10. In a selective jet plating apparatus having a central hub member, a plurality of fluid jets disposed about said hub manner and means for pumping a plating fluid from said jets, the improvement comprising:

a pair of spaced rotatable concentric annular rim members for supporting a metal strip, said rim members being concentrically disposed on opposite sides of said fluid jets, and forming a slot at their periphery in registration with said fluid jets behind said strip for exposing a predetermined area of said strip to a plating fluid from said jets;

means for supporting said rim members concentrically with respect to said hub member;

means for rotating said rim members relative to said hub member and said fluid jets whereby a metal strip supprted on said rim members is transported past said fluid jets; and means for causing a current to flow in the fluid flowing between said fluid jets and said metal strip whereby a metal in said fluid from said jets is plated on said strip in the area exposed by said slot as said strip is transported past said fluid jets on said rim members.

11. The improvement according to claim 10 wherein each of said fluid jets comprises a metallic nozzle having a predetermined position relative to said metal strip, said current-causing means comprises means for coupling a source of potential between the nozzle of each of said jets and said strip and, further, wherein each of said predetermined positions is adjustable for adjusting the magnitude of current flowing between said position and said strip.

12. The improvement according to claim 11 further comprising means for adjusting the size of said slot between said rim members.

13. The improvement according to claim 11 further comprising means for adjusting the position of said strip relative to said slot.

14. The improvement according to claim 11 wherein said potential source-coupling means comprises a plurality of electrode means adapted for making a sliding contact with said strip.

15. The improvement according to claim 11 further comprising a belt member and means for threading said belt member about the periphery of said rim members for over lapping the back of said strip beyond the edges of said slot so as to prevent a loss of plating fluid through said strip in the event that the strip has holes in it in fluid communication with said slot.

* * * * *